US005430982A

United States Patent [19]

Bane

[11] Patent Number: 5,430,982

[45] Date of Patent: Jul. 11, 1995

[54] STORM PANEL SYSTEM WITH CONTINUOUS RUN RAILS AND SPRING CLIPS

[76] Inventor: Robert F. Bane, 159 E. 7th St., Hialeah, Fla. 33010

[21] Appl. No.: 217,254

[22] Filed: Mar. 24, 1994

[51] Int. Cl.[6] ..... E06B 3/26

[52] U.S. Cl. ..... 52/202; 52/204.69; 52/204.62; 52/506.01; 49/464

[58] Field of Search ..... 52/202, 203, 387, 386, 52/384, 506.01, 506.05, 204.62, 776, 204.7, 204.69; 49/404

[56] References Cited

U.S. PATENT DOCUMENTS

| | | | |
|---|---|---|---|
| 2,456,486 | 12/1948 | Berghoff | 52/202 |
| 2,583,303 | 1/1952 | Oltz . | |
| 2,767,814 | 10/1956 | Johnson . | |
| 3,760,541 | 9/1973 | Fulcher | 52/203 |
| 3,824,753 | 7/1974 | Anderson | 52/202 |
| 4,074,483 | 2/1978 | Vickstrom | 52/202 |
| 4,179,859 | 12/1979 | Fricko | 52/397 |
| 4,235,056 | 11/1980 | Griffin | 52/397 |
| 4,333,271 | 6/1982 | DePaolo et al. | 49/464 |
| 4,733,510 | 3/1988 | Werner | 52/202 |
| 4,873,803 | 10/1989 | Rundo | 52/202 |
| 5,123,211 | 6/1992 | Schlicht | 52/202 |

*Primary Examiner*—Carl D. Friedman
*Assistant Examiner*—Kien T. Nguyen
*Attorney, Agent, or Firm*—Robert C. Kain, Jr.

[57] ABSTRACT

The storm panel system is utilized in conjunction with a substantially planar storm panel. A pair of rails are adapted to be mounted to opposing sides of adjacent wall portions surrounding a window or opening in a building. Each rail defines a first and a second continuous U-shaped channel. The first U-shaped channel is disposed in a plane substantially parallel to a storm panel plane defined by the storm panel. The second continuous U-shaped channel is disposed in a plane normal to the storm panel plane. The second channel has a channel mouth which abuts and is closed by the adjacent wall portions when the rail is mounted on the wall. Anchor bolts, nails, screws or other mounting devices are utilized to mount each rail on the adjacent wall portion. After the substantially planar storm panel is placed between the pair of rails covering the window or opening, a plurality of spring load clips is utilized to retain the storm panel on the building. Each spring load clip has a U-shaped leg which is adapted to be inserted into the first U-shaped channel by an interference fit. Each clip also includes a body section, preferably a solid triangular body section, which transfers horizontally directed forces from the storm panel to the U-shaped clip leg. Each clip also includes a contact leg normal to the U-shaped clip leg which has a terminal end which contacts the storm panel when the clip is inserted into the rail.

8 Claims, 2 Drawing Sheets

STORM PANEL SYSTEM WITH CONTINUOUS RUN RAILS AND SPRING CLIPS

BACKGROUND OF THE INVENTION

The present invention relates to a storm panel system having continuous run rails when coact with spring clips to retain a storm panel over a window or an opening in a building.

In many parts of the country, residents or building owners sometimes utilize storm panels to protect windows and openings in buildings from the force of wind, rain, hail and wind driven objects. Particularly in the states along the Gulf of Mexico and in Florida, and extending upwards of the East Coast, citizens and building owners sometimes board up or utilize storm panels to protect against hurricane force winds.

One known hurricane panel and security device is disclosed in U.S. Pat. No. 4,333,271 to DePaolo et al. The DePaolo system utilizes a corrugated type storm panel which is locked in place by an upper, inverted U-shaped channel defined by an upper railing and a plurality of M-shaped clips which protrude through a lower rail defining a horizontal plane retaining the lower edges of the corrugated panel. One half of the M-shaped clip is disposed above the horizontal plane established by the bottom rail and the other half of the M-shaped is disposed below that bottom rail.

U.S. Pat. No. 2,767,814 to Johnson discloses a clip for a storm window insulating strip. The Johnson system utilizes a U-shaped panel also having a M-shaped clip wherein a finger protruding in the U-shaped channel bears upon the mid-region of the M-shaped clip. The bottom leg of the clip rests in the bottom of the U-shaped channel. The upper leg of the clip bears against the storm window. U.S. Pat. No. 3,760,541 to Fulcher discloses a conical shaped protector. U.S. Pat. No. 2,583,303 to Oltz discloses a fastener defined as a solid triangular shape which creates a U-shaped channel for a window for storm shutter. U.S. Pat. No. 4,074,483 to Vickstrom discloses a storm window system. U.S. Pat. No. 3,824,753 to Anderson discloses a window structure defining a U-shaped channel with a plurality of inboard directed lips inboard of the U-shaped channel. U.S. Pat. No. 5,123,211 to Schlicht et al. discloses a garage door light incorporating a uniquely shaped clip which is placed in a complementary shaped channel in the casement of the window. U.S. Pat. No. 4,179,859 to Fricko et al. discloses a molding retaining clip for an automobile. U.S. Pat. No. 4,235,056 to Griffin also discloses a glass retaining clip.

OBJECTS OF THE INVENTION

It is an object of the present invention to provide a storm panel system having a continuous run rail placed on opposing peripheral sides of a storm panel wherein the storm panel is held in place by a plurality of spring clips disposed in the continuous run rails and bearing against peripheral edge regions of the storm panel.

It is another object of the present invention to provide a storm panel system wherein the rails are extruded in a continuous run and define a pair of U-shaped channels extending throughout the length of the rail.

It is a further object of the present invention to utilize spring load clips having a U-shaped clip leg which is inserted into one of the U-shaped rail channels with an interference fit. It is an additional object of the present invention to provide a storm panel system which is easy to manufacture and easy to mount or install on a residence or building.

It is a further object of the present invention to provide a storm panel system which can be easily installed by the home or building owner.

It is another object of the present invention to provide a storm panel system wherein the home or building owner can easily mount the storm panel into the system thereby covering the window or opening in the building.

It is an additional object of the present invention to provide a storm panel system with a rail that is designed to by utilized at the intersection between two walls meeting at a 90° angle with respect to each other.

SUMMARY OF THE INVENTION

The storm panel system is utilized in conjunction with a substantially planar storm panel. A pair of rails are adapted to be mounted to opposing sides of adjacent wall portions surrounding a window or opening in a building. Each rail defines a first and a second continuous U-shaped channel. The first U-shaped channel is disposed in a plane substantially parallel to a storm panel plane defined by the storm panel. The second continuous U-shaped channel is disposed in a plane normal to the storm panel plane. The second channel has a channel mouth which abuts and is closed by the adjacent wall portions when the rail is mounted on the wall. Anchor bolts, nails, screws or other mounting devices are utilized to mount each rail on the adjacent wall portion. After the substantially planar storm panel is placed between the pair of rails covering the window or opening, a plurality of spring load clips is utilized to retain the storm panel on the building. Each spring load clip has a U-shaped leg which is adapted to be inserted into the first U-shaped channel by an interference fit. Each clip also includes a body section, preferably a solid triangular body section, which transfers horizontally directed forces from the storm panel to the U-shaped clip leg. Each clip also includes a contact leg normal to the U-shaped clip leg which has a terminal end which contacts the storm panel when the clip is inserted into the rail.

BRIEF DESCRIPTION OF DRAWINGS

Further objects and advantages of the present invention can be found in the detailed description of the preferred embodiment when taken in conjunction with the accompanying drawings in which.

DETAILED DESCRIPTION OF THE PREFERRED EMBODIMENT

The present invention relates to a storm panel system for securing a substantially planar storm panel.

Figure 1:
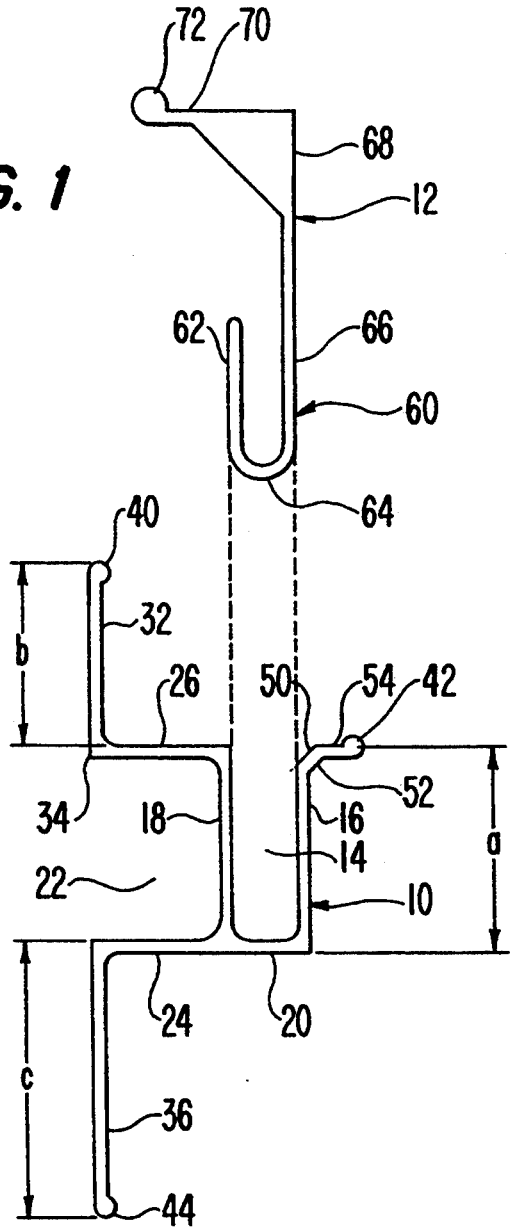
FIG. 1 diagrammatically illustrates a continuous run rail and an associated spring clip.

FIG. 1 diagrammatically illustrates a rail 10 and a spring load clip 12. Rail 10 defines a first continuous U-shaped channel 14 having outermost channel wall 16, innermost channel wall 18, and bottom channel wall 20.

Rail 10 also defines a second U-shaped channel 22 which is particularly defined by outermost or outboard channel wall 24, inboard channel wall 26 and a bottom channel wall which is also the inboard channel wall 18 for first channel 14. The depth of the second channel in one working embodiment is approximately 0.7".

An inboard directed flange 32 leads from mouth 34 of second channel 22 inboard or towards the storm panel (discussed later with respect to FIG. 3) away from inboard channel wall 26.

Rail 10 also includes a second flange 36 which extends outboard and away from mouth 34 of second channel 22 and particularly outboard from outboard channel wall 24 of second channel 22. In one embodiment, the depth "a" of first channel 14 is substantially equivalent to the width of second channel 22 which is, in one working embodiment, approximately 1.2". In one working embodiment, flange 32 has a dimension "b" approximately equivalent to 1.0" and flange 36 has a span "c" approximately equal to 1.5". Terminal ends 40, 42, and 44 of flange 32, outboard channel wall 16, and flange 36 are configured as a cross-sectional bead shape in order to strengthen the edge and limit and reduce the possibility of injury to the user or installer of the storm panel system. Further, first channel 14 may include a mouth 50 defined by an outwardly sloped wall segment 52 and a short outboard extending wall segment 54 which is normal to U-shaped channel 14.

Spring clip 12 is adapted to be inserted into U-shaped channel 14. Clip 12 includes a U-shaped leg 60 consisting of free leg section 62, curved section 64, and intermediate leg section 66. Intermediate leg section 66 leads to a solid, triangular shaped clip body 68 which transfers horizontally directed forces to the U-shaped clip leg 60 from contact leg 70. Contact leg 70 has a terminal end 72 which is configured, in the preferred embodiment, as a cross-sectional bead to reinforce the terminal end since it contacts the storm panel.

Figure 2:
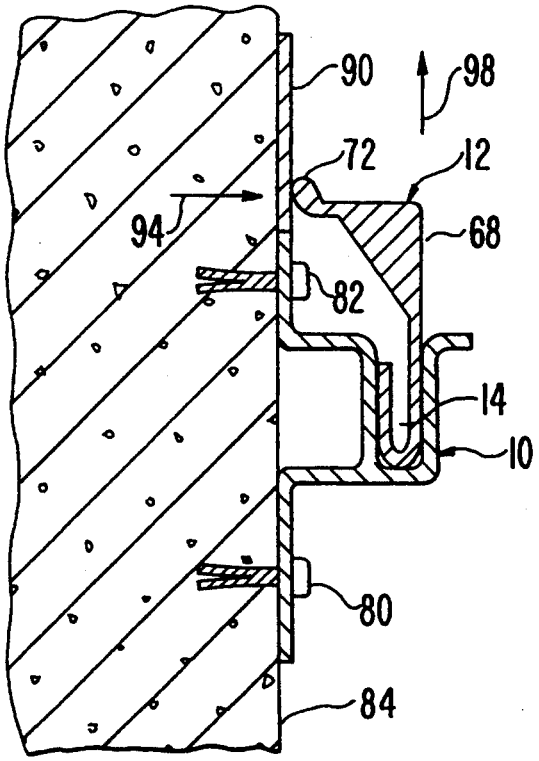
FIG. 2 diagrammatically illustrates the rail and the clip retaining a storm panel.

FIG. 2 diagrammatically illustrates spring clip 12 inserted into channel 14 of continuous rail 10. In FIG. 2, a mounting system 80, 82 has mounted rail 10 onto wall 84. The mounting system 80, 82 could consist of anchor bolts, nails, screws, or an anchor with drive pin and threadable bolt described in U.S. patent application Ser. No. 08/199,456, owned by the inventor of the present application, and filed on Feb. 22, 1994. 1994. The contents of the aforementioned patent application for anchor with drive pin and threadable bolt are incorporated herein by reference thereto.

FIG. 2 shows that a substantially planar storm panel 90 is being held in place on wall 84 by terminal end 72 of clip 12. Horizontally directed forces, in the direction show by arrow 94, are transferred via clip body 68 to rail 10. The user of the storm panel system simply pulls clip 68 in the direction shown by arrow 98 to remove the clip. Thereafter, storm panel 90 can simply be removed from the building.

Figure 3:
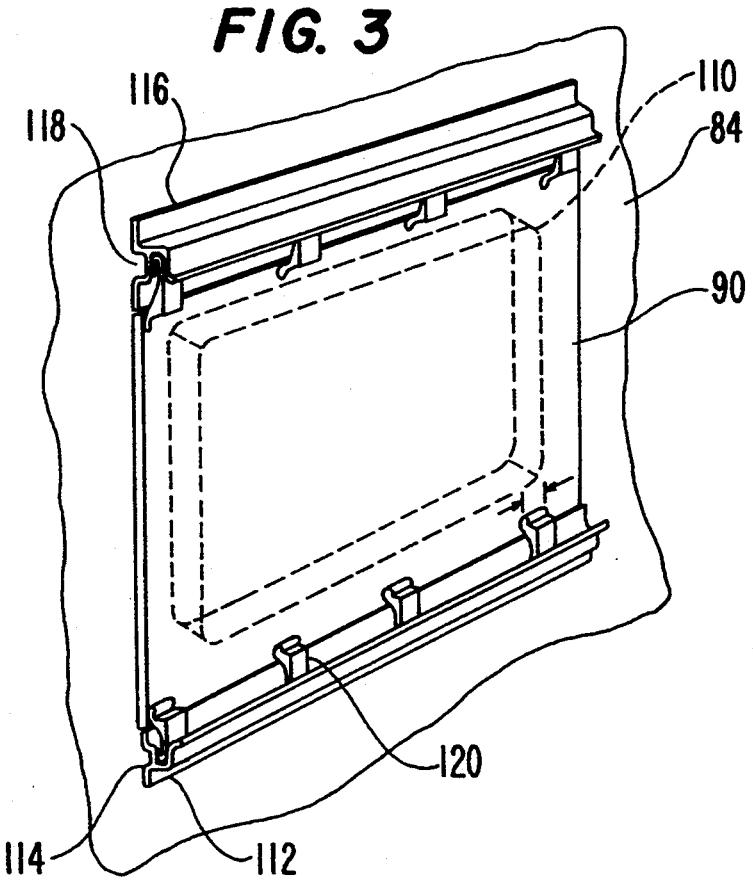
FIG. 3 diagrammatically illustrates the storm panel covering an opening or a window on a building and retained thereover by a plurality of spring clips mounted in top and bottom continuous run rails.

FIG. 3 diagrammatically illustrates storm panel 90 mounted on wall 84 and particular the adjacent wall portions surrounding window 110. In the illustrated embodiment, a bottom rail 112 has been mounted to the lower region of wall portion 114. An upper rail 116 has been mounted to upper wall portion 118. The second U-shaped channels corresponding to U-shaped channel 22 in FIG. 1, are closed due to abutment against adjacent wall portions 114, 118. A plurality of spring load clips, one of which is clip 120, coact against storm panel 90 and the upper and lower continuous rails 112, 116.

It is important to note that the present rail systems can be created by a continuous roll or extrusion process since the rails do not have any breaks, bends, or other special turns as is common in other storm shutter systems. The first and second U-shaped channels in the rails provide strength, not only horizontally with respect to forces acting on the storm panel during a storm, but also vertically and laterally. The second U-shaped channel transfers horizontal forces both above and below the center line of the rail due to flanges 32 and 36. The first U-shaped channel 14, in addition to the U-shaped clip leg 60, provides spring action to first retain storm panel 90 securely over window 110 but also permit the user to remove clip 68 by upward withdrawal of the clip as noted by arrow 98 in FIG. 2. Further, the user can select the number of clips he or she may want to utilize to secure the storm panel on the building. Although four clips are shown for the top and bottom rail in FIG. 3, the user may select more or less depending upon his or her need for security.

Due to the simplicity of construction, the user can simply withdraw all the clips and remove storm panel 90 by laterally moving the storm panel away from wall 84. Likewise, the storm panel is easily installed on a building by placing the storm panel between rails which are mounted on opposing peripheral side regions of the storm panel and then inserting a plurality of spring load clips in a direction opposite to arrow 98 shown in FIG. 2.

As illustrated in FIG. 3, the rails are continuous run rails. Accordingly, these rails can be installed on a building simply by bringing a long length of preformed rail and cutting that rail to the specific length needed. This continuous rail construction avoids the necessity of custom made storm panel systems. In a preferred embodiment, the lateral dimension "d" of the clip is at least 60% of the critical height of the clip which is dimension "a" plus dimension "b" in FIG. 1. Dimension "a" is the depth of the first channel 14 and dimension "b" is the height of flange 32. In a preferred embodiment, dimension "a" plus dimension "b" equals approximately 2.3", whereas the lateral dimension "d" of the clip is approximately 1.3".

Other storm panel systems use openings or slots which may become clogged with debris over time. The present invention avoids that problem since the rails define continuous channels. If one portion of the channel is blocked, the user can simply insert the clip in another portion of the channel. Further, since a continuous channel is defined throughout the length of the rail, the user can simply run a stick, screwdriver or rod through the continuous channel thereby clearing the clip bearing channel of debris or other obstruction.

In other storm shutter systems such as, for example, the one described by DePaolo in U.S. Pat. No. 4,333,271, the holes through the rails for the clips may become clogged, bent or worn. These problems are avoided by the present invention since a continuous run U-shaped channel is defined by the rails.

Figure 4:
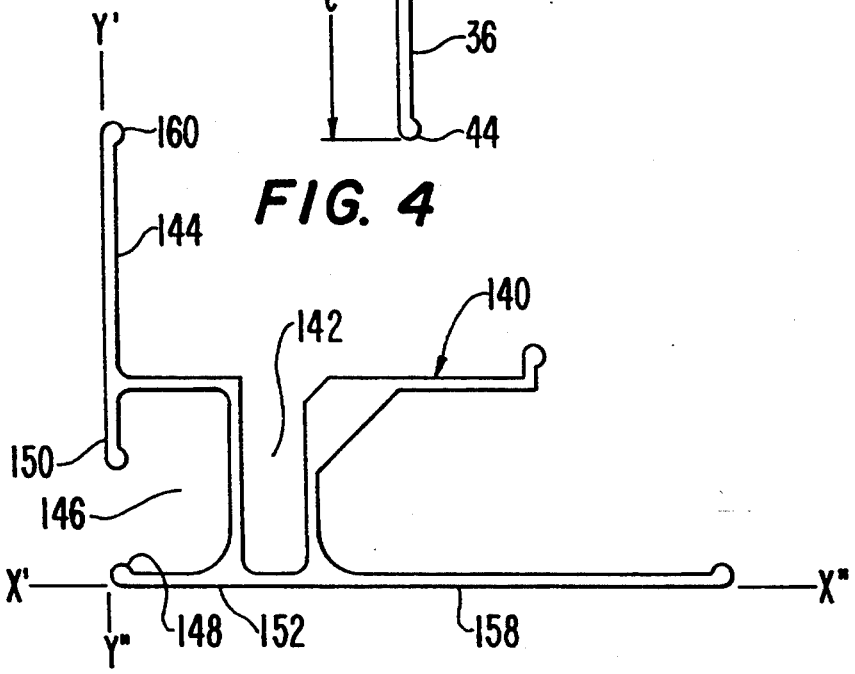
FIG. 4 illustrates another embodiment of the rail.

FIG. 4 diagrammatically illustrates a second embodiment of rail 140. Rail 140 includes a first U-shaped channel 142 that retains the spring load clip 12 illustrated in FIG. 1. Rail 140 also includes a first flange 144 which extends inboard or towards the storm panel from the second U-shaped channel 146. U-shaped channel 146 is closed due to abutment against the adjacent wall portion. Additionally, mouth 148 of U-shaped channel 146 is partially obstructed by leg 150. Leg 150 is substantially coplanar with respect to flange 144 and provides additional stability for rail 140. The outboard-most channel wall 152 of second channel 146 is substantially coplanar with a second flange 158. Flange 158, as well as channel wall 152, would be placed in abutment with a wall about plane x'-x''. The wall through plane x'-x'' would be normal to the wall at plane y'-y''. The anchor bolts or screws would be placed in flange 144 as well as flange 158. In this manner, a storm panel would be mounted generally within plane y'-y'' and the spring load clips would be mounted in U-shaped channel 142 and extending above terminal edge 160 of flange 144.

The claims appended hereto are meant to cover modifications and changes within the spirit and scope of the present invention.

What is claimed is:

1. A storm panel system comprising:

a substantially planar storm panel adapted to be overlaid on a window or an opening:

a pair of rails adapted to be mounted to wall portions on opposing sides of said window or opening and opposing sides of said storm panel, each rail defining a first continuous U-shaped channel disposed in a plane substantially parallel to a storm panel plane defined by said overlaid storm panel, said fast U-shaped channel facing said storm panel plane, each rail further defining a second continuous U-shaped channel disposed in a plane normal to said storm panel plane, said second U-shaped channel having a channel mouth which is adapted to abut and be closed by adjacent wall portions when said rail is mounted thereon, said first and second channels being continuous over the length of said rails and substantially spanning an entire peripheral side region of said storm panel plane;

means for mounting said pair of rails on said wall portions; and a plurality of spring load clips, each said clip having a U-shaped leg which is inserted into said first U-shaped channel by an interference fit, each clip further having a body section which transfers horizontally directed forces to the U-shaped clip leg, and a horizontally oriented contact leg having a terminal end which is adapted to contact said overlaid storm panel when said clip is inserted into said rail.

2. A storm panel system as claimed in claim 1 wherein each said rail includes at least one flange leading in a plane parallel to said storm panel plane away from said second U-shaped channel and along said adjacent wall portion, said means for mounting attached to said flange.

3. A storm panel system as claimed in claim 2 wherein said at least one flange is a first flange, said first flange protruding away from said second U-shaped channel towards said window.

4. A storm panel system as claimed in claim 3 including a second flange leading in a plane parallel to said storm panel plane away from said second U-shaped channel and away from said window along said adjacent wall portion, said means for mounting attached to said first and second flanges.

5. A storm panel system as claimed in claim 3 including a second flange extending normal to said storm panel plane and in a substantially similar plane as a plane defined by an outboard element of said second U-shaped channel, said outboard element being disposed at an outboard-most position away from said storm panel.

6. A storm panel system as claimed in claim 5 wherein said means for mounting is attached to said first and second flanges.

7. A storm panel system as claimed in claim 1 wherein said body section of said clip defines a substantially solid triangular element spanning said U-shaped leg and said contact leg.

8. A storm panel system as claimed in claim 7 wherein a lateral dimension of said clip spanning the length of the trough of said U-shaped clip leg is at least 60% of a height of said clip from the bottom of said U-shaped leg to a plane defined by said contact leg.

* * * * *